US005404773A

United States Patent [19]

Norville

[11] Patent Number: 5,404,773

[45] Date of Patent: Apr. 11, 1995

[54] CAM-ACTION RATCHET-TYPE WRENCH

[76] Inventor: Burl O. Norville, 2113 Huntington, Pasadena, Tex. 77506

[21] Appl. No.: 144,229

[22] Filed: Oct. 27, 1993

Related U.S. Application Data

[63] Continuation of Ser. No. 926,275, Aug. 10, 1992, abandoned.

[51] Int. Cl.[6] ..... B25B 13/46

[52] U.S. Cl. ..... 81/63.1; 192/43.2; 81/59.1

[58] Field of Search ..... 81/59.1, 63.1, 58, 58.4; 192/43, 43.2

[56] References Cited

U.S. PATENT DOCUMENTS

| | | | |
|---|---|---|---|
| 2,127,003 | 8/1938 | Nash | 81/59.1 |
| 2,139,650 | 12/1938 | Anderson et al. | 81/59.1 |
| 2,201,705 | 5/1940 | Stone | 192/43.2 |
| 3,265,171 | 8/1966 | Kilness | 192/43.2 |
| 3,447,650 | 6/1969 | Dossier | 192/43 |
| 3,590,667 | 7/1971 | Berglein | 81/59.1 |
| 4,873,898 | 10/1989 | Chern | 81/59.1 |
| 5,086,673 | 2/1992 | Korty | 81/63.1 |

FOREIGN PATENT DOCUMENTS

| | | | |
|---|---|---|---|
| 43991 | 9/1916 | Sweden | 192/43 |

*Primary Examiner*—James G. Smith
*Attorney, Agent, or Firm*—Kenneth A. Roddy

[57] ABSTRACT

A cam-action ratchet-type wrench has a handle with a hand grip portion at one end and a generally cylindrical head portion at the opposite end. A cylindrical torque transmitting member rotatably disposed within the head portion has an outwardly extending portion for connection to a socket for rotating a workpiece. A pair of cam wedge members movably disposed in laterally opposed spaced relation within rectangular slots in the head portion have inwardly facing curved surfaces. A direction selection disk rotatably mounted in the head portion above the torque transmitting member has a pin disposed between the cam wedge members. A direction selection lever on the handle rotates the direction selection disk to selectively engage the pin with one of the pair of cam wedge members to move the curved surface of the engaged cam wedge member into and out of engagement with the cylindrical surface of the torque transmitting member. The cam wedge members can be moved from a locked position wherein the handle, the torque transmitting member, and head portion rotate together as a single unit in both a clockwise and counterclockwise direction to an engaged position wherein one cam wedge member is disengaged from the torque transmitting member and upon rotation of the handle, the opposed cam wedge member becomes wedged between the slot and the torque transmitting member to cause the handle, torque transmitting member, and head portion to rotate together as a single unit in one direction only while allowing free relative rotational movement in the opposite direction.

1 Claim, 2 Drawing Sheets

CAM-ACTION RATCHET-TYPE WRENCH

This application is a continuation of U.S. patent application Ser. No. 07/926,275, filed Aug. 10, 1992,now abandoned.

BACKGROUND OF THE INVENTION

1. Field of the Invention

This invention relates generally to hand tools which transmit rotational torque in a clockwise or counterclockwise direction, and more particularly to a cam-action ratchet-type hand tool which transmits rotational torque in a clockwise or counterclockwise direction between a driving element and a resisting element or workpiece.

2. Brief Description of the Prior Art

Hand held ratcheting tools are known which are used in conjunction with various types of attachable sockets to engage and rotate nuts, bolts, screws and other types of fasteners used in the fields of construction and manufacturing. Most prior art ratcheting tools use a pawl and toothed ratchet wheel combination which engage to produce a rotational torque on a workpiece in a selected rotational direction. Because of the required mating and interlocking of the pawl with the toothed ratchet wheel in these ratcheting tools the amount of counter-rotation of the work handle to back up for subsequent forward rotation is determined by the size of the interlocking pieces.

In order to reduce the amount of counter-rotation to the pawl and wheel, the mating pieces must be decreased. This reduction in size leads to a weakening of wrench strength which is based solely on the strength of the mating pieces. This size reduction will increase the work space limits of the wrench because of less counter- rotation of the wrench handle, but it also decreases the rotational torque that can be transferred to the workpiece. To increase the strength of the wrench, which would allow a much higher torque load transferred to the rotated workpiece, the pawl and toothed wheel mating pieces must be enlarged.

However, the enlargement of the mating pawl and toothed wheel also increases the amount of counter-rotation of the wrench handle because the wrench handle must be moved a greater distance to achieve the engagement of the interlocking pieces. This increased movement limits the wrench usage in a tight work space.

There are several patents which disclose ratchet-type hand wrenches.

Anderson et al, U.S. Pat. No. 2,139,650 discloses a wrench having a roller clutch mechanism wherein the head has a series of recesses arranged about a cylindrical rotor with a pair of rod-like rollers vertically disposed in each recess. A pair of springs urge the rollers into locking engagement between the cylindrical portion of the rotor and the bottom of the respective recess. A series of pins are carried by a disk to disengage one roller of the pair of rollers and the disk is rotatably retained by a snap ring. Anderson et al does not teach wedge members having flat surfaces or the use of a curved surface on the wedge members to conform to the cylindrical surfaces of the torque transmitting member.

Dossier, U.S. Pat. No. 3,447,650 discloses a one-way friction clutch wherein the effect of centrifugal force is used to disengage the clutch when the speed of rotation exceeds a given value. The device has a central shaft surrounded by an outer sleeve with two ring segments disposed in the space between the shaft and the outer sleeve. The opposed ends of the ring segments are provided with raised surfaces. The outer sleeve has a pair of recesses 180° apart with an angled camming surface at the rear of each recess. A flat wedge is disposed in each recess and has an angled rear surface corresponding to the angled surface of the recess which requires that one side of the wedge be narrower than the other. The inner facing surface of each wedge has an angled cut-out defining a pair of protruding branches which are angled and slidably bear upon flat surfaces of the raised surfaces at the end of the ring segments. A spring at one side of each wedge normally urges each wedge in a counterclockwise direction wherein the angled rear surfaces of the wedges ride on the camming surface of the recesses and urge the wedges inward which causes the angled surfaces of the branches of the wedges to ride downwardly on the flat surfaces at the end of the ring segments. This draws the ends of the ring segments together and draws the ring segments radially inward to normally engage the shaft while the outer sleeve rotates freely in one direction, but is prevented from rotation in the opposite direction. Upon the outer sleeve exceeding a given speed of revolution, the centrifugal force overcomes the pressure of the springs, the wedge moves up (outwardly) on the angled surface, and the ring segments move radially outward to engage the outer sleeve.

Simometta, U.S. Pat. No. 3,677,102 discloses a wrench having a driving element with a toothed bore and a resisting element rotatably disposed in the bore. A pawl member is movably disposed in a slot in the resisting element and has two toothed ends which alternately engage the toothed bore to impart torque in one direction. The pawl is held in its selected operating position by a spring biased ball.

Lee, U.S. Pat. No. 3,958,470 discloses a double acting ratchet wrench employing a cam actuated positive drive oscillatory pawl which is engageable by a slight movement of the wrench handle and held tightly engaged by hand pressure on the handle.

Solomon, U.S. Pat. No. 4,063,626 discloses a silent ratchet in which a friction brake ring engages a pawl with the ratchet teeth in an annular ring. The friction brake ring carries the pawl into toothed engagement when the handle of the wrench is rotated in the direction in which it is desired to rotate a workpiece and a spring within the ratchet returns the pawl to a position in which it is disengaged entirely when the pressure on the handle is released to prevent the teeth from clicking on the return stroke of the handle.

Chern, U.S. Pat. No. 4,873,898 discloses a wrench wherein the head has a cylindrical recess with a series of concave receptacles arranged about a cylindrical driving head piece and a series of rod-like posts vertically carried by a rotatable circular post plate which has a notch extending inwardly from its circumference. A lever switch is pivotally mounted on the wrench handle and has a protuberence which is received in the notch for rotating the post plate and posts between a clockwise and counterclockwise position to move the rod-like posts out of their receptacles and into engagement between the exterior of the cylindrical driving head piece and the cylindrical recess in the head.

Korty, U.S. Pat. No. 5,086,673 discloses a wrench having a cylindrical recess in the head with three inwardly extending projections which define three radially extending partitions surrounding a central spindle. A vertical roller is located in each partition with with a coil spring at each side. A retainer cover having extensions between each partition and one end of each coil spring is rotatably secured in the cylindrical recess by a split ring.

Swedish patent 43,991 discloses a "Bar Feed Attachment" wherein an inner cylindrical member having an outer cylindrical surface is secured to an axle and is driven by the back and forth movement of an arcuate ring segment having a U-shaped cross section which is mounted on the periphery of the inner cylindrical member. Clamp members are rotatably mounted on pins in the ring segment and each has a curved outer surface tangent to the inner periphery of the outer ring segment and an inward facing curved surface. Spacers slidably disposed between the outer periphery of the inner cylindrical member and the clamp members each have curved indentations on an outward facing side in which the inward facing curved surface of the adjacent clamp rolls, and an inward facing surface which is slidably received on the outer periphery of the inner cylindrical member. The radius of curvature of the curved indentations in the spacers is greater than the radius of curvature of the tangent curved surfaces of the clamps so that the clamps partially roll in the curved indentations. Stop bolts disposed on each side of the spacers limit their circumferential movement relative to the outer ring segment. Outer springs are mounted between the outer sides of the clamps and a rigid part of the outer ring segment and inner springs are mounted between the inner sides of the clamps and opposed slide members connected with the outer ring. segment. The slides are displaced by a cam disk. The outer convex curved surfaces of the clamps cooperate tangentially with the concave curved peripheral surface of the ring segment and the concave curved surfaces of the indentations of the spacers to press the curved surface of the spacers against the cylindrical surface of the inner cylindrical driven member. Thus, the torque is transmitted through the tangent curved surfaces of the clamp which acts as a roller. The curved surfaces of the clamps engage the concave curved surface of the outer ring segment and concave curved surface of the indentations in the spacers only at the single point of tangency, and hence there is only minimum surface area in contact to transmit torque to the inner cylindrical member.

The present invention is distinguished over the prior art in general, and these patents in particular by a cam-action ratchet-type wrench having a handle with a hand grip portion at one end and a generally cylindrical head portion at the opposite end. A cylindrical torque transmitting member is rotatably disposed within the head portion and has a socket connection portion extending outwardly from the head portion for connection to a socket for rotating a workpiece. A pair of cam wedge members are movably disposed in laterally opposed spaced relation within rectangular slots in the head portion and have inwardly facing curved surfaces. A direction selection disk is rotatably mounted in the head portion above the torque transmitting member and has a pin member disposed between the cam wedge members. A direction selection lever on the handle rotates the direction selection disk to selectively engage the pin with one of the pair of cam wedge members to move the curved surface of the engaged cam wedge member into and out of engagement with the cylindrical surface of the torque transmitting member. The cam wedge members can be moved from a locked position wherein the handle, the torque transmitting member, and head portion rotate together as a single unit in both a clockwise and counterclockwise direction to an engaged position wherein one cam wedge member is disengaged from the torque transmitting member and upon rotation of the handle, the opposed cam wedge member becomes wedged between the slot and the torque transmitting member to cause the handle, torque transmitting member, and head portion to rotate together as a single unit in one direction only while allowing free relative rotational movement in the opposite direction.

SUMMARY OF THE INVENTION

It is therefore an object of the present invention to provide a cam-action ratchet-type hand wrench which utilizes cam wedge members to produce a locking action between the wrench body and socket disk to provide a very high torque level on a rotated workpiece without wrench failure.

It is another object of this invention is to provide a hand wrench that requires very little rotational movement before a rotational torque force is applied to the workpiece thus providing improved hand tool performance in a tight work space.

Another object of this invention is to provide an improved hand wrench that is virtually free of noise from the mechanism while in operation.

A further object of this invention is to provide a hand wrench that may be easily disassembled and assembled for cleaning, inspection and possible repair or replacement of interior operating pieces.

A still further object of this invention is to provide a hand wrench which is simple in construction, economical to manufacture and is rugged and durable in use.

Other objects of the invention will become apparent from time to time throughout the specification and claims as hereinafter related.

The above noted objects and other objects of the invention are accomplished by a cam-action ratchet-type wrench having a handle with a hand grip portion at one end and a generally cylindrical head portion at the opposite end. A cylindrical torque transmitting member is rotatably disposed within the head portion and has a socket connection portion extending outwardly from the head portion for connection to a socket for rotating a workpiece. A pair of cam wedge members are movably disposed in laterally opposed spaced relation within rectangular slots in the head portion and have inwardly facing curved surfaces. A direction selection disk is rotatably mounted in the head portion above the torque transmitting member and has a pin member disposed between the cam wedge members. A direction selection lever on the handle rotates the direction selection disk to selectively engage the pin with one of the pair of cam wedge members to move the curved surface of the engaged cam wedge member into and out of engagement with the cylindrical surface of the torque transmitting member. The cam wedge members can be moved from a locked position wherein the handle, the torque transmitting member, and head portion rotate together as a single unit in both a clockwise and counterclockwise direction to an engaged position wherein one cam wedge member is disengaged from the torque transmitting member and upon rotation of the handle, the opposed cam wedge member becomes wedged between the slot and the torque transmitting member to cause the handle, torque transmitting member, and head portion to rotate together as a single unit in one direction only while allowing free relative rotational movement in the opposite direction.

DESCRIPTION OF THE PREFERRED EMBODIMENT

Figure 1:
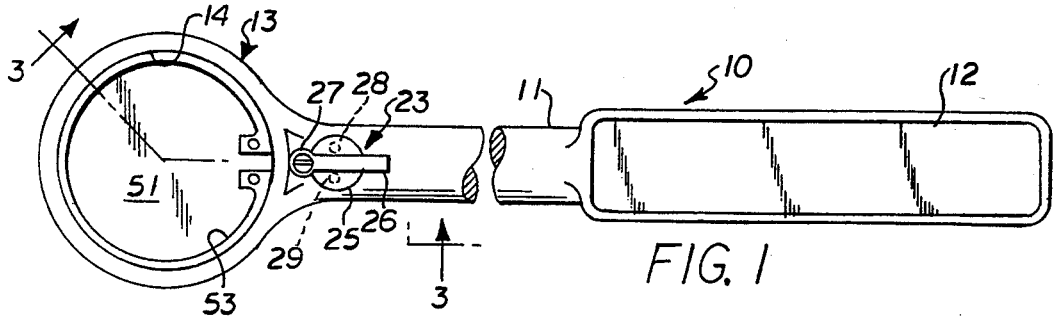
FIG. 1 is a top plan view of the cam-action ratchet-type wrench in accordance with the present invention.

Referring to the drawings by numerals of reference, there is shown in FIG. 1, a preferred hand-held cam-action ratchet-type wrench 10 having an elongate handle 11 with a hand grip portion 12 at one end and a cylindrical head portion 13 at the opposite end.

Figure 2:
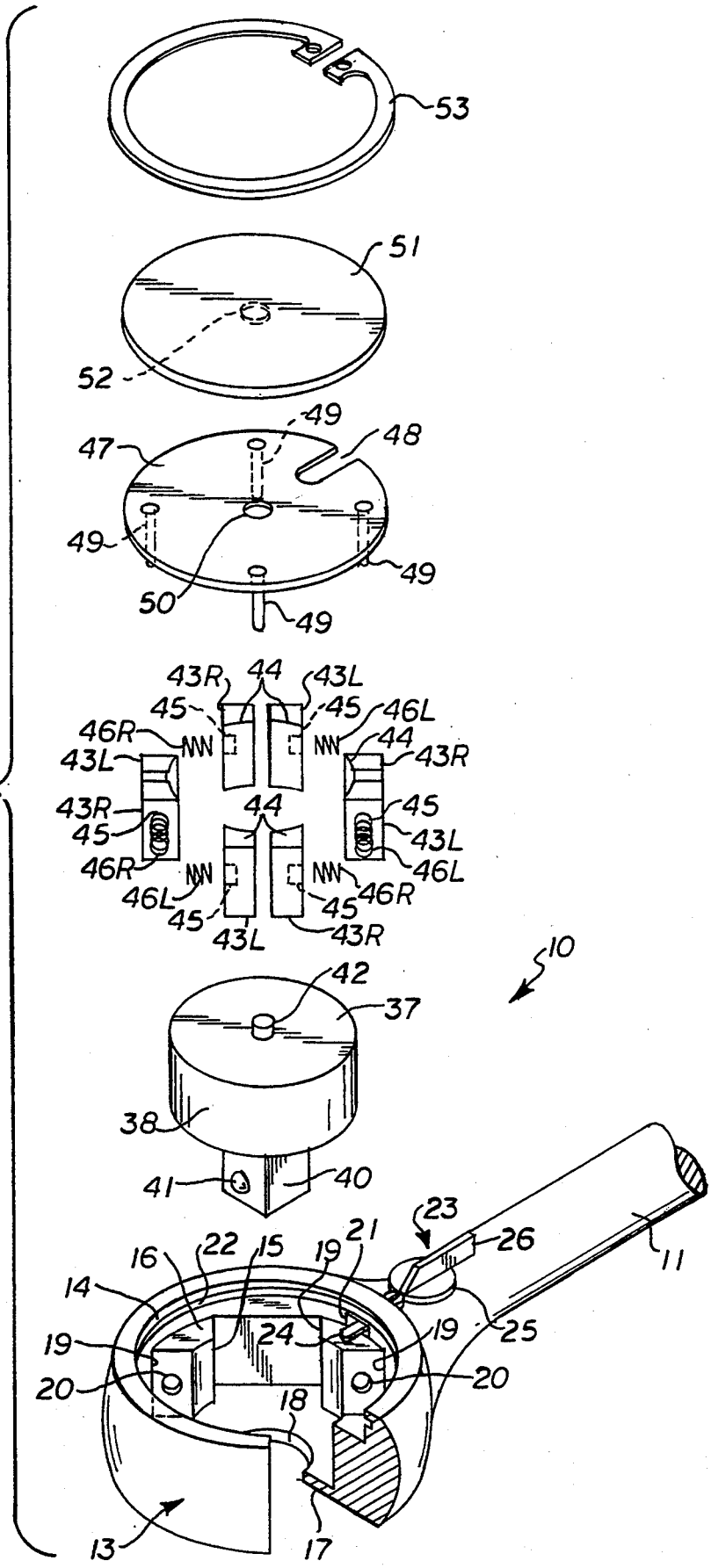
FIG. 2 is an exploded isometric view of the head portion of the cam-action ratchet-type wrench showing the interior components in an unassembled condition.

The torque transmitting components housed within the head portion 13 are shown in an unassembled condition in FIG. 2. The cylindrical head portion 13 has a first large central bore 14 which extends downwardly from the top and terminates in an intermediate smaller bore 15 defining a radial shoulder 16 therebetween. The intermediate bore 15 extends downwardly and terminates at the bottom wall 17. A third small bore 18 extends through the bottom wall 17. A series of circumferentially spaced rectangular slots 19 extend radially outward a distance into the shoulder 16 from the intermediate bore 15. The laterally opposed sides of the slots 19 are provided with a small recess 20 (FIG. 2) which receives one end of a small compression spring (described hereinafter). A small circumferential slot 21 extends through the sidewall of the cylindrical head portion 13 above the shoulder 16 in alignment with the longitudinal axis of the handle 11. A snap ring groove 22 is formed in the side wall at the upper end of the central bore 14.

A direction selection lever 23 having a generally rectangular tongue 24 at its forward end and a circular base 25 with a raised thumb rest 26 at its rearward end is pivotally connected to the handle 11 by a shouldered screw 27 intermediate its ends which allows the direction selection lever 23 to be pivoted to the left or right about the screw without binding on the handle. The rectangular tongue 24 extends through the slot 21 and is pivotally disposed atop the shoulder 16 and the circular base 25 and thumb rest 26 portion is pivotally disposed on the handle. A pair of laterally spaced concave indentations 28 and 29 are formed in the underside of the circular base 25.

Figure 3:
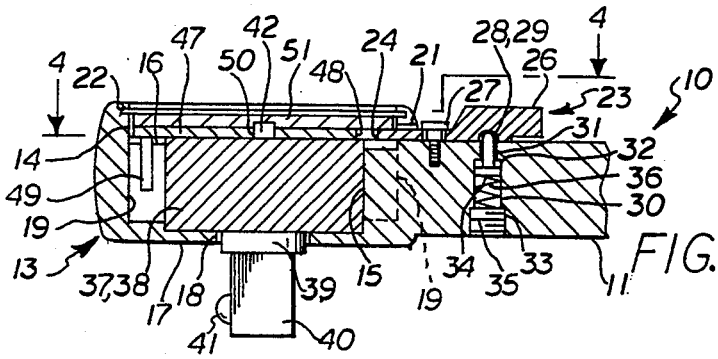
FIG. 3 is a side elevation view in partial cross section of the head portion of the cam-action ratchet-type wrench taken along line 3—3 of FIG. 1.

Referring additionally to FIG. 3, the handle 11 has a vertical bore 30 adjacent the cylindrical head portion 13 which extends upwardly from the bottom and terminates in a smaller bore 31 extending through the top wall of the handle and defining a shoulder 32 therebetween. The lower end of the bore 30 is provided with internal threads 33. A conventional latch pin 34 is slidably received within the bore 30 and has a rounded nose portion which extends through the smaller bore 31 and a flange portion positioned adjacent the shoulder 32. A screw plug 35 is threadedly received in the bottom of the bore 30. A compression spring 36 is retained in the bore 30 with one end engaged on the flange portion of the latch pin 34 and its other end engaged on the screw plug 35 to normally urge the rounded nose portion of the latch pin upwardly.

A socket disk 37 is slidably and rotatably received within the intermediate bore 15. The socket disk 37 has a main cylindrical portion 38 with a smaller cylindrical portion 39 on the underside and a square male socket element 40 at the bottom thereof. The smaller cylindrical portion 36 and square male socket element 40 extend through the small third bore 18 in the bottom wall 17 of the cylindrical head portion 13. The square male socket element 40 is configured to be received in standard socket members conventional in the art and is preferably provided with the usual spring biased ball detent mechanism 41. A central dowel pin 42 extends upwardly a short distance from the top of the cylindrical portion 38 of the socket disk 37.

As best seen in FIG. 2, a series of pairs of cam wedges 43L and 43R are received in the circumferentially spaced rectangular slots 19. Each cam wedge 43L, 43R is a generally rectangular member having a curved inner surface 44 corresponding to the radius of curvature of the intermediate bore 15. Thus, when viewed in transverse cross section, the outer side of each cam wedge member is wider than its inner side. The outer side of each cam wedge 43L and 43R is provided with a small recess 45 which receives one end of a small compression spring 46L and 46R, respectively. The compression springs 46L and 46R have one end engaged in the recess 20 of the slots 19 and the other end engaged in the recess 45 of the respective cam wedge 43L, 43R to normally urge the cam wedges outwardly from the opposed side walls of the slots 19 toward one another.

A direction selection disk 47 is slidably received within the larger first central bore 14 of the cylindrical head portion 13. The direction selection disk 47 is a flat disk member having a slot 48 slightly larger than the tongue 24 of the direction selection lever 23 extending inwardly from one side and a series of vertical pins 49 which depend from its underside. The direction selection disk 47 has a small central bore 50 and is positioned such that the dowel pin 42 atop the socket disk 37 is received through the bore 50 and the tongue 24 of the direction selection lever 23 received in the slot 48 and the pins 49 of the disk 47 received in the slots 19 between the cam wedges 43L and 43R. In the installed position, the direction selection disk 47 will rotate to the left or right about the dowel pin 42 as the direction selection lever 23 is pivoted to the left or right.

A flat disk shaped cover plate 51 is slidably received within the larger first central bore 14 of the cylindrical head portion 13 to rest slidably on the top surface of the direction selection disk 47. The cover plate 51 has a central recess 52 on its underside to receive the top end of the dowel pin 42 extending from the top end of the socket disk 37. A snap ring 53 is installed in the snap ring groove 22 in the upper end of the central bore 14 to releasably secure the components in the assembled condition.

OPERATION

Figure 4:
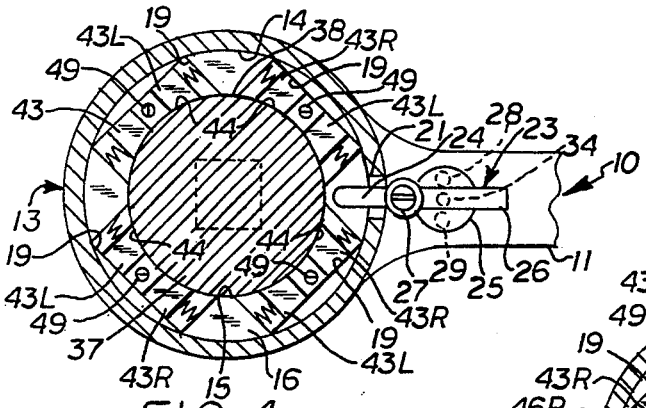
FIG. 4 is a top plan view in partial cross section of the head portion of the cam-action ratchet-type wrench taken along line 4—4 of FIG. 3, showing the interior components in a double wedged or locked position.
Figure 5:
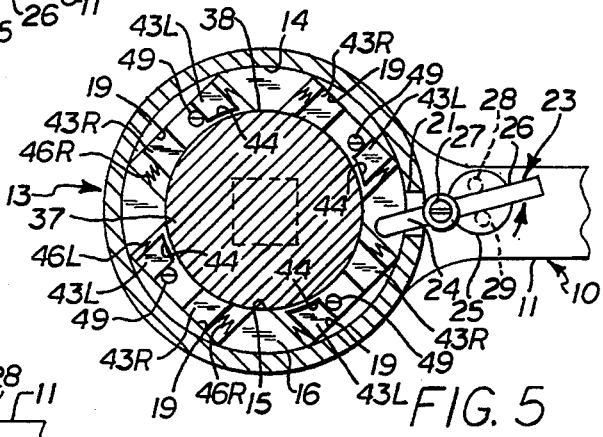
FIG. 5 is a top plan view in partial cross section of the head portion of the cam-action ratchet-type wrench similar to FIG. 4, showing the interior components set for a clockwise rotating position.
Figure 6:
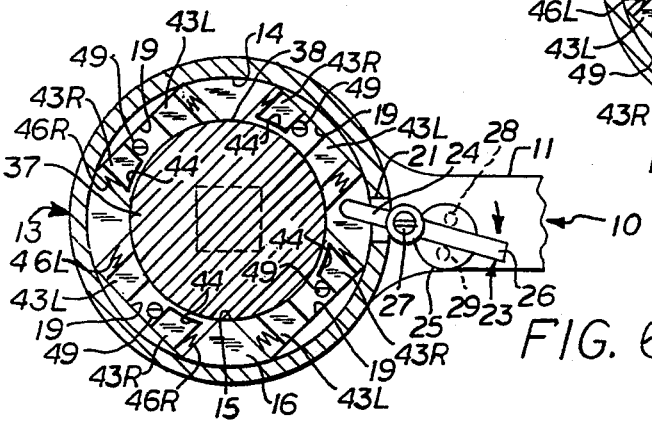
FIG. 6 is a top plan view in partial cross section of the head portion of the cam-action ratchet-type wrench similar to FIG. 4, showing the interior components set for a counterclockwise rotating position.

In the following discussion, it should be understood that a conventional socket has been installed on the square male socket element 40 of the socket disk 37, and the socket has been placed on a workpiece (nut, bolt, etc.,) to be rotated. Torque forces are transmitted from the handle 11 to the socket disk 37 in a clockwise or counterclockwise direction by either the cam wedges 43L or 43R in the following manner. In FIGS. 4, 5, and 6, the pins 49 of the direction selection disk 47 are shown, but the flat portion of the disk is not shown to more clearly show the camming action of the cam wedges.

FIG. 4 shows the wrench 10 in a double wedged or locked position. In the locked position, the direction selection lever 23 is aligned with the longitudinal axis of the handle 11 and the pins 49 of the direction selection disk 47 are positioned at the center of the slots 19 between the cam wedges 43L and 43R. In the locked position, the curved inner surfaces 44 of the cam wedges 43L and 43R are firmly engaged on the outer surface of the cylindrical portion 38 of the socket disk 37. The handle 11 can be rotated clockwise or counterclockwise and the cam wedge pairs will remain engaged on the circumference of the socket disk 37, preventing relative movement. Desired clockwise or counterclockwise rotation of the socket disk 37 and workpiece connected thereto is achieved by pivoting the thumb rest 26 of the direction selection lever 23 to the desired position (left or right).

FIG. 5 shows the wrench 10 set for rotation in the counterclockwise direction. In this position, the thumb rest 26 of the direction selection lever 23 is pushed to the right pivoting the tongue portion 24 to the left and allowing the latch pin 31 (FIG. 3) to engage the indentation 29 in the base 25. Since the tongue portion 24 is engaged in the slot 48 of the direction selection disk 47, when the tongue portion moves to the left, the disk 47 rotates clockwise and the pins 49 depending from the disk engage the cam wedges 43L and compress the springs 46L. In this position, only the cam wedges 43L are moved laterally toward one side wall of the slots 19 out of engagement with the outer surface of the socket disk 37. Simultaneously, the cam wedges 43R are forced outwardly from the opposite side wall of the slots 19 by springs 46R and frictionally engage the outer surface of the socket disk 37.

With only the cam wedges 43R engaged on the socket disk 37, as the handle 11 is rotated a fraction of a degree in a counterclockwise direction, the cam wedges 43R will become tightly wedged between the outer surface of the socket disk 37 and the back wall of the slots 19. Thus, as the handle is rotated counterclockwise, the cam wedges 43R will prevent relative rotation between the socket disk 37 and head portion 13 causing the socket disk and workpiece connected thereto to rotate in a counterclockwise direction. If the handle is rotated clockwise with only the wedges 43R engaged, the wedging action of the cam wedges 43R is reversed and the cam edges will slide on the circumference of the socket disk 37 in a clockwise direction relative to the socket disk.

FIG. 6 shows the wrench 10 set for rotation in the clockwise direction. In this position, the thumb rest 26 of the direction selection lever 23 is pushed to the left pivoting the tongue portion 24 to the right and allowing the latch pin 31 (FIG. 3) to engage the indentation 28 in the base 26. Since the tongue portion 24 is engaged in the slot 48 of the direction selection disk 47, when the tongue portion moves to the right, the disk 47 rotates counterclockwise and the pins 49 depending from the disk engage the cam wedges 43R and compress the springs 46R. In this position, only the cam wedges 43R are moved laterally toward one side wall of the slots 19 out of engagement with the outer surface of the socket disk 37. Simultaneously, the cam wedges 43L are forced outwardly from the opposite side wall of the slots 19 by springs 46L and frictionally engage the outer surface of the socket disk 37.

With only the cam wedges 43L engaged on the socket disk 37, as the handle is rotated a fraction of a degree in a clockwise direction, the cam wedges 43L will become tightly wedged between the outer surface of the socket disk 37 and the back wall of the slots 19. Thus, as the handle is rotated clockwise, the cam wedges 43L will prevent relative rotation between the socket disk 37 and head portion 13 causing the socket disk and workpiece connected thereto to rotate in a clockwise direction. If the handle is rotated counterclockwise with only the wedges 43L engaged, the wedging action of the cam wedges 43L is reversed and the cam edges will slide on the circumference of the socket disk 37 in a counterclockwise direction relative to the socket disk.

By removing the snap ring 53, the wrench 10 can be easily disassembled for cleaning, inspection, and possible repair or replacement of the operating components and can quickly and easily reassembled.

It can be seen from the foregoing description, that the present cam action ratchet-type wrench will produce a high torque force on a workpiece to be rotated due to the wedging action of the cam wedges and requires very little movement before the rotational torque force is applied to the workpiece thus making it suitable for use in a tight work space. Another important feature of the present cam action wrench is that it is virtually free of noise from the torque mechanism while in operation.

Although the wrench has been shown and described with 4 pairs of cam wedges, it should be understood that the wrench may also be provided with any number of pairs of cam wedges.

While this invention has been described fully and completely with special emphasis upon a preferred embodiment, it should be understood that within the scope of the appended claims the invention may be practiced otherwise than as specifically described herein.

What is claimed is:

1. A wrench for selectively transmitting torque to a workpiece in a clockwise or counterclockwise direction comprising:

an elongate handle having a hand grip portion at one end and a generally cylindrical head portion at the opposite end;

said head portion having a central vertical bore extending inwardly from one end of said head portion, and at least one generally rectangular slot extending radially outwardly from said central vertical bore and terminating in a flat outer surface, each said slot having laterally opposed flat side surfaces perpendicular to said flat outer surface;

a generally cylindrical torque transmitting member having a cylindrical portion rotatably disposed within said head portion vertical bore to move relative thereto and having a lower portion extending outwardly from said head portion and configured to be connected to a workpiece;

at least one pair of laterally opposed generally rectangular cam wedge members slidably disposed in said generally rectangular slot;

each said cam wedge member having a flat top and bottom end, laterally opposed flat side surfaces, one of said laterally opposed side surfaces being wider than the other, a flat back surface, and a concave front surface curved to conform to the curvature of said torque transmitting member cylindrical portion and each said concave front surface selectively engaged on said cylindrical torque transmitting member cylindrical portion; and each said pair of cam wedge members positioned with the narrower side surfaces facing each other in laterally spaced relation, said wider side surfaces on the outer side of said pair of cam wedge members facing said laterally opposed side surfaces of said slot and said flat back surfaces slidably engaged on said slot flat outer surface;

spring means disposed between said laterally opposed side surface of each said slot and said wider side surfaces of each said cam wedge member to normally urge said pair of cam wedge members toward one another;

a flat disk member rotatably mounted in said head portion vertical bore above said torque transmitting member and having at least one pin member selectively engageable with either one of said pair of cam wedge members and having a slot extending radially inward from one side;

a lever member pivotally connected on said handle portion having a thumb rest portion at one end to receive the thumb of the user for pivoting said lever member and having a tongue portion at the opposite end slidably received in said flat disk member radially extending slot for rotating said disk in a clockwise or counterclockwise direction to selectively engage said pin member with one member of said pair of cam wedge members to move the curved surfaces of the engaged said cam wedge member into and out of engagement with said torque transmitting member cylindrical portion;

releasable latch means operatively connected with said lever member to maintain said flat disk member in a rotated position with said pin member engaged with one of said cam wedge members to maintain its curved surface out of engagement with said torque transmitting member cylindrical portion;

a flat disk-shaped cover member removably mounted in said head portion vertical bore to enclose the open end thereof and cover said torque transmitting member, said cam wedge members, and said flat disk member; and snap ring means removably mounted in said head portion vertical bore to releasably secure said cover member in said head portion vertical bore;

said lever member and said flat disk member operatively connected with said pair of cam wedge members to selectively move said cam wedge member curved surfaces between a locked position and a direction engaged position such that in the locked position, said spring means urges both members of each said pair of cam wedge members toward one another such that the curved surface of both said cam wedge members are engaged with said torque transmitting member cylindrical portion wherein said handle, said head portion, and said torque transmitting member rotate together as a single unit in both a clockwise and counterclockwise direction; and in the direction engaged position, one member of said pair of cam wedge members is moved laterally by said pin member to disengage its curved surface from said torque transmitting member cylindrical portion and upon rotation of said handle relative to said torque transmitting member in the opposite direction from said laterally moved cam wedge member, the opposed cam member will become wedged between said slot and said torque transmitting member cylindrical surface with its curved surface firmly engaged thereon to prevent relative rotational movement therebetween in that same direction and cause said handle, said torque transmitting member, and said head portion to rotate together as a single unit in one direction and apply torque to the workpiece connected to said torque transmitting member; and upon rotation of said handle relative to said torque transmitting member in the reverse direction the wedged cam wedge member is carried by said head portion to become un-wedged such that its curved surface is slidably engaged on said torque transmitting member cylindrical portion to allow relative rotational movement therebetween in the reverse direction.

* * * * *